United States Patent [19]

Livanos et al.

[11] Patent Number: 4,625,627

[45] Date of Patent: Dec. 2, 1986

[54] VENTILATED CABINET FOR CONTAINING GAS SUPPLY VESSELS

[75] Inventors: Vassilios J. Livanos, Fort Lee; Eugene Y. Ngai, White House Station, both of N.J.

[73] Assignee: Matheson Gas Products, Inc., Secaucus, N.J.

[21] Appl. No.: 735,977

[22] Filed: May 20, 1985

[51] Int. Cl.[4] ..... F24F 3/16

[52] U.S. Cl. ..... 98/32; 98/115.3

[58] Field of Search ..... 98/1, 115.3, 32; 312/115, 257, 213; 220/85 S, 367

[56] References Cited

U.S. PATENT DOCUMENTS

| | | | |
|---|---|---|---|
| 1,155,889 | 10/1915 | Clarke . | |
| 1,714,823 | 5/1929 | Soper . | |
| 1,922,147 | 8/1933 | Wales | 312/115 |
| 2,627,220 | 2/1953 | Morrow | 98/115.3 |
| 2,730,421 | 1/1956 | Burst et al. | 312/257 |
| 2,774,808 | 12/1956 | Bullock | 174/16 |
| 2,810,337 | 10/1957 | Samuelson et al. | 98/115.3 |
| 2,832,366 | 4/1958 | Farison | 137/101.11 |
| 3,184,275 | 5/1965 | Gardner | 312/213 |
| 3,394,645 | 7/1968 | Acker | 98/32 |
| 3,570,385 | 3/1971 | Heisterkamp | 98/32 |
| 3,657,991 | 4/1972 | Oberg | 98/32 |
| 3,933,186 | 1/1976 | Scheffler | 141/97 |

FOREIGN PATENT DOCUMENTS

| | | | |
|---|---|---|---|
| 603034 | 4/1926 | France | 98/32 |

OTHER PUBLICATIONS

"Gas Storage and Use Cabinets Provide Controlled Containment of Gas Cylinders in the Electronics Manufacturing Plant", Microelectronic Manufacturing and Testing, May 1981, by Dennis Donegan.

"Toxic Bottle Vented Enclosure" Brochure—Capital Glass Corporation.

"Gas Cabinet"—Advertising Brochure of Airco Industrial Gases.

"Gas Handling Safety Enclosures"—Brochure of Semi--Gas Systems Incorporated.

"Gas Handling/Storage Safety Cabinet"—Brochure of Scientific Gas Products, Inc.

"Gas Cylinder Storage Cabinets"—Brochure of Flocon, Inc.

*Primary Examiner*—Lloyd L. King

*Attorney, Agent, or Firm*—Dann, Dorfman, Herrell and Skillman

[57] ABSTRACT

A gas cabinet for enclosing one or more compressed gas cylinders is ventilated for rapid removal of any gas leaked from the cylinders. The cabinet has a perforated plate as its floor which also serves as a fresh air inlet. Since the entire floor is used as the air inlet, the airflow through the interior of the cabinet is uniform and across the full width and depth of the cabinet, virtually eliminating dead areas or channels where leaked gas could accumulate. A tapered roof provides a smooth air handling transition to an exhaust port in the roof. The exhaust port may be connected to a plant ventilation system for removing the exhausted air from the cabinet.

10 Claims, 4 Drawing Figures

VENTILATED CABINET FOR CONTAINING GAS SUPPLY VESSELS

FIELD OF THE INVENTION

This invention relates generally to industrial gas supply systems and, more particularly, to a cabinet for housing gas cylinders or other gas vessels and for containing and rapidly evacuating any gas leaking therefrom.

BACKGROUND OF THE INVENTION

The extensive use of various highly toxic gases in the fabrication of electronic semiconductor devices has led to the use of gas cabinets for containment of the gas cylinders. Gas cabinets are substructures for the containment of process gas cylinders within the manufacturing plant. Such cabinets provide a secure, ventilated housing to safely contain both the cylinders and the system controls. The cabinet is designed to protect the cylinders and the controls from accidental damage and also to provide a controlled access to the gas cylinders. Although not meant to be totally sealed, gas cabinets are generally designed to resist leakage of gases into the plant atmosphere.

In the event that a leak should occur within the cabinet, it is necessary that there be adequate ventilation to provide a rapid clearing of the atmosphere inside the cabinet. Thus, it is desirable that there be a complete, uniform, and continuous air sweep of the cabinet interior.

Conventional gas cabinets utilize either front or side-mounted louvers for air inlet into the cabinet and an exhaust port at the top of the cabinet. Such an arrangement can result in channeling, dead areas, and unswept corners where possible leaking gas can accumulate. The conventional method of compensating for this problem has been to connect the cabinets to very high capacity ventilation systems. Such cabinets require airflows on the order of 350 cubic feet per minute or greater for a single cylinder cabinet. Such high capacity ventilation systems are, of course, more expensive to install and maintain. Furthermore, in a plant utilizing multiple cabinets in a single room, it is possible that a partial vacuum may be created in the room such that entry to the room is hindered. Thus, it is desirable to have a gas cabinet which will provide a rapid clearing time and thorough evacuation but utilizing lower airflows.

SUMMARY OF THE INVENTION

A gas cabinet according to this invention includes generally a housing having upright wall means comprising in the present instance three walls and a hinged door. ventilation is provided through a perforated floor plate air inlet and a tapered roof having an exhaust port. The perforated floor plate makes up the full width and depth of the floor surface of the cabinet and provides a relatively unobstructed inlet for fresh air into the cabinet. During normal operation, the cabinet door is closed and latched such that the only source of air to the cabinet is through the perforated floor plate.

The gas cabinet may be provided with an elevating support base to allow ingress of the ambient air through the perforated floor plate or the entire floor plate of the cabinet may be connected to a plenum or duct for supplying ventilating air.

BRIEF DESCRIPTION OF THE DRAWINGS

The foregoing summary, as well as the following detailed description of a preferred embodiment of the present invention, will be better understood when read in conjunction with the appended drawings, in which.

DESCRIPTION OF THE PREFERRED EMBODIMENT

Figure 1:
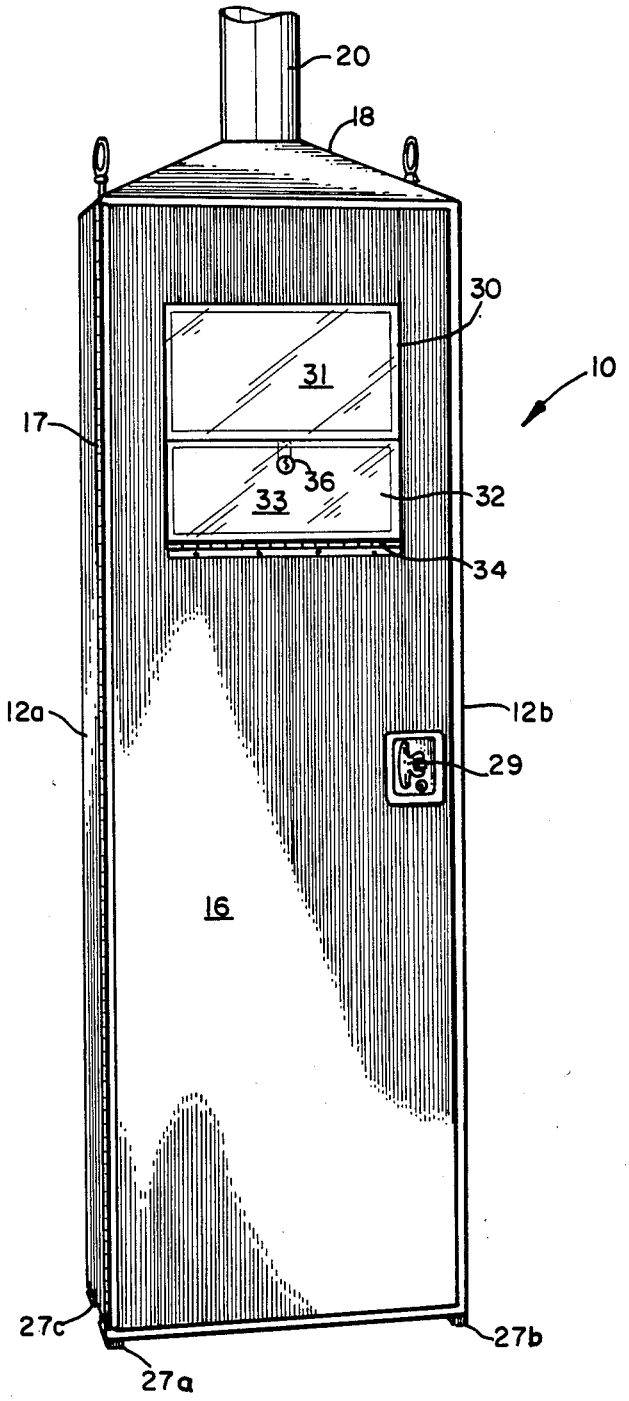
FIG. 1 is a frontal view of a gas cabinet according to the invention in normal operating condition.

Referring now to the drawings wherein like reference numerals indicate identical or corresponding elements across the several views, and in particular to FIG. 1, there is shown generally a gas cabinet 10 according to the invention. Gas cabinet 10 has sidewalls 12*a* and 12*b* and a back wall 14 (not shown). A door 16 is attached to sidewall 12*a* by means of hinge 17. Hinge 17 may consist of a continuous hinge of conventional design such as a piano-type hinge.

Gas cabinet 10 also includes a tapered roof 18 having an exhaust conduit 20. Exhaust conduit 20 is formed for connection to a plant ventilation system. Exhaust conduit 20 may include a damper for manually or automatically throttling the airflow through exhaust conduit 20.

Gas cabinet 10 is provided with elevating feet 27*a*, 27*b*, 27*c*, and 27*d* (not shown). These feet 27*a–d* support the cabinet slightly off the floor to provide an air space beneath it.

Door 16 is equipped with an observation or viewing port 30 having a transparent cover 31, such as a window made of wired glass or Lexan ®, and an access port 32 adjacent the viewing port having a displaceable panel 33 which may be opened in order to operate the controls mounted within cabinet 10. The panel 33 for access port 32 may be fabricated from Lexan ® or sheet metal and is attached to the door 16 by means of a continuous hinge 34. A locking latch 36 is also provided to lock access port panel 33 in the closed position, thereby preventing unauthorized entry to the cabinet. Access port 32 is dimensioned and positioned such that under normal operation conditions as described below, no gas may escape through the port 32 when panel 33 is in the open position.

Figure 2:
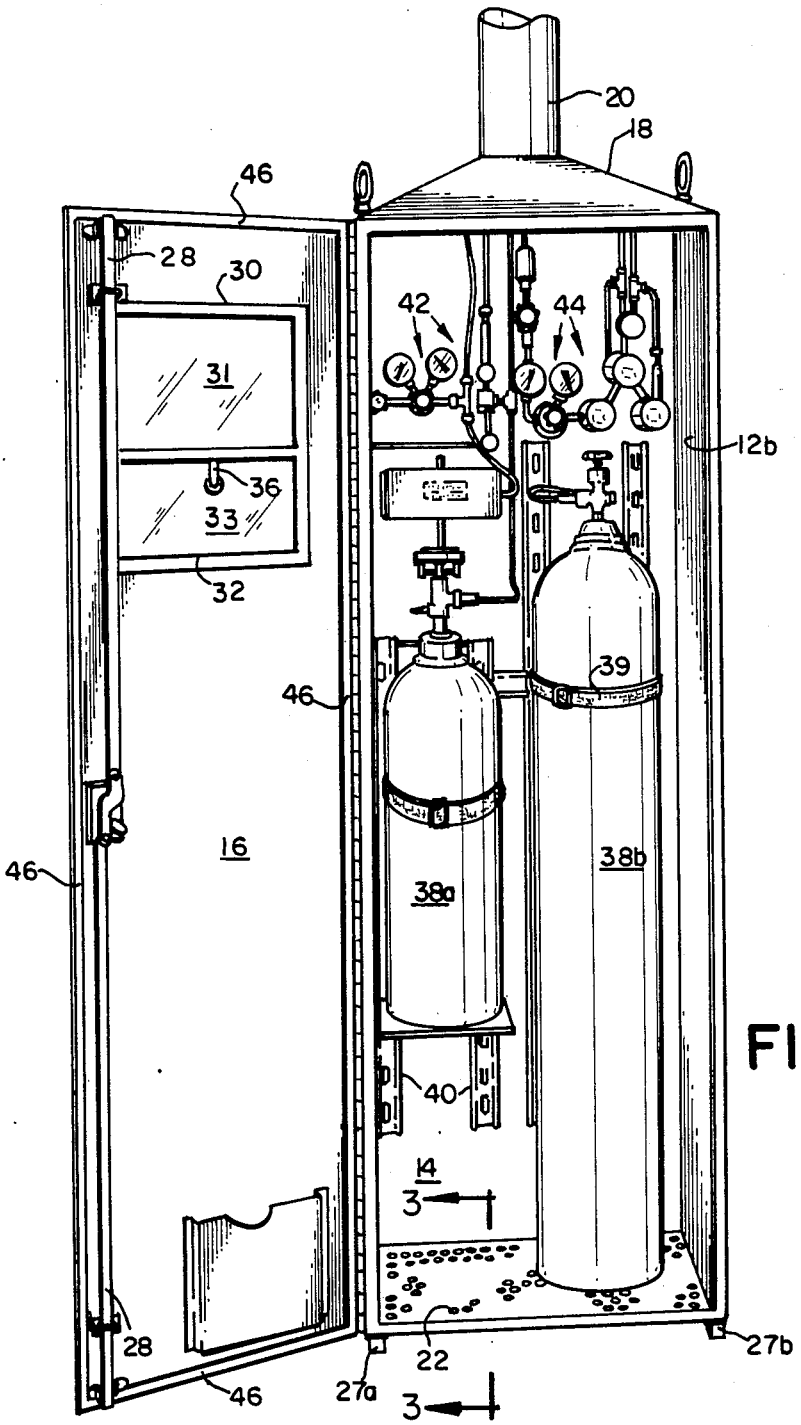
FIG. 2 shows a cabinet with its front open to expose the interior of the cabinet, for example as when replacing the gas cylinders.
Figure 3:
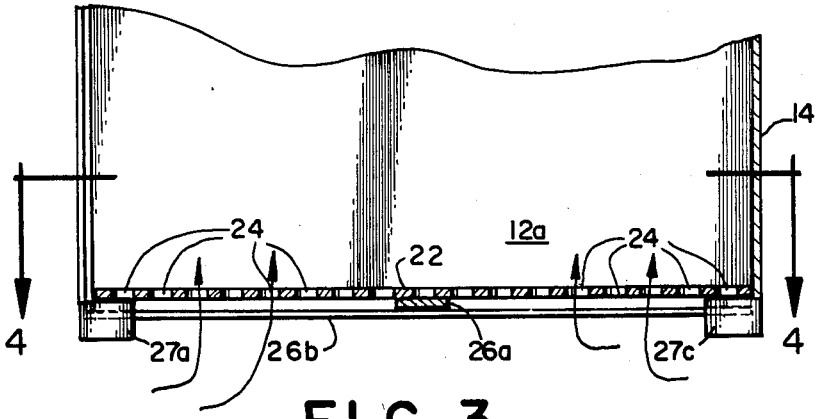
FIG. 3 is a fragmentary cross-sectional view of the lower part of the cabinet showing the airflow through perforated floor plate as viewed along line 3—3 of FIG. 2.
Figure 4:
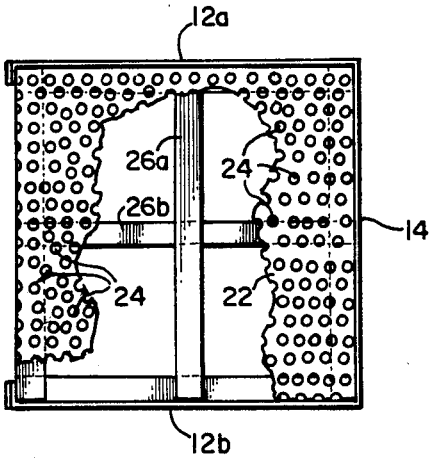
FIG. 4 is a cut-away plan view of the perforated floor plate and supporting elements utilized in the gas cabinet as viewed along line 4—4 of FIG. 3.

Referring now to FIG. 2, there is shown generally the interior of gas cabinet 10. A perforated floor plate 22 extends across the full depth and width of gas cabinet 10 and forms the floor thereof. As shown in FIGS. 3 and 4, perforated floor plate 22 serves not only as a floor for the gas cabinet 10 but also as an air inlet. Perforated floor plate 22 is fabricated of metal plate, such as steel, having a plurality of holes 24 formed therein. Although the number of holes 24 in the perforated floor plate 22 may vary to some degree depending on particular needs, for most applications the perforated floor plate 22 should have substantially 42% open area. Cross beams 26*a* and 26*b* may be provided as additional supports for perforated floor plate 22 to help in supporting the weight of the gas cylinders.

As previously discussed, elevating feet 27*a–d* are provided to support the cabinet 10 and to create an air space beneath it. This relationship is shown more clearly in FIG. 3 and a typical airflow into the gas cabinet is indicated by the arrows. Although FIG. 1 shows air inlets on four sides of the cabinet, inlets on two opposite sides only would be sufficient. The open area of perforated floor plate 22 may be adjusted in reference with the plant ventilation system capacity such that a uniform airflow is provided for sweeping the interior of cabinet 10. This airflow should generally be in the range of 66–89 feet per minute. However, for most applications, a flow of 77 feet per minute is adequate to provide a satisfactory clearing time for evacuating the cabinet. The upright wall means of the cabinet provide a flow passage of substantially uniform cross section. Tapered roof 18 provides a gradually reduced cross-sectional area for a smooth air handling transition into exhaust conduit 20. Since the present invention permits reduced airflow, the purification of the air exhausted through the conduit 20 to remove any entrained gas therefrom is facilitated.

Referring back to FIG. 2, there is shown a three-point latching mechanism 28 for securing door 16 in the closed position. The perimeter of door 16 is gasketed with a conventional gasketing material 46 such as neoprene to provide a tight seal when door 16 is closed.

Gas cylinders 38*a* and 38*b* are supported in cabinet 10 by means of adjustable support members 40 fastened to backwall 14. Cylinder support members 40 may comprise rack uprights, connectors and shelves, for example, formed of conventional structural components such as Unistrut®. A strap or chain 39 is utilized for tying the upper portion of a gas cylinder, for example 38*b*, to the cylinder support members 40.

The gas controls 42 and purge panel 44 are located in the upper portion of gas cabinet 10 and mounted on backwall 14.

Some of the many novel features and advantages of the present invention are now apparent in view of the foregoing description. For example, a gas cabinet 10 is provided with a perforated floor plate 22 for allowing air from outside the cabinet to enter across the full depth and width of the cabinet floor, uniformly pass through the gas cabinet 10, and be exhausted through exhaust port 20 at the top of the cabinet. In this manner any leaking gas may be rapidly removed. It will be appreciated that although a cabinet for housing two cylinders has been described, the novel concepts of the invention may also be applied to single or multiple cylinder cabinets.

From the foregoing description and the accompanying drawings, it can be seen that the present invention provides a novel apparatus for housing gas cylinders and for rapidly and uniformly evacuating toxic gases leaked therefrom. It will be recognized by those skilled in the art that changes or modifications may be made to the above-described embodiment without departing from the broad inventive concepts of the invention. It is understood, therefore, that the invention is not limited to the particular embodiment which is disclosed but is intended to cover all modifications and changes which are within the scope and spirit of the invention as defined in the appended claims.

What is claimed is:

1. A cabinet for enclosing a gas vessel and the associated gas flow regulating equipment during its use in an industrial gas dispensing system, said cabinet being adapted to be mounted on a support base and connected to ventilation means causing air to flow through the cabinet and around the gas vessel to carry away any gas leaking from the vessel and the regulating equipment in the cabinet, said cabinet having upright wall means forming an elongated upright housing for receiving the vessel and the associated equipment, a perforated floor member providing a relatively unobstructed inlet for air at the bottom of said cabinet and a tapered roof at the top of said cabinet, said floor member extending across the full depth and width of the housing and being mounted above said support base to permit a free uniform airflow across the full depth and width of the cabinet bottom so that a uniform airflow is provided for sweeping the interior of said cabinet, said tapered roof providing a gradually reduced cross-sectional flow area terminating in a conduit for exhausting air and any entrained gases from said housing by the ventilating means, said upright wall means providing a flow passage of substantially uniform cross-sectional area from said floor plate to the roof, said wall means including an access door extending substantially from the floor to the roof to allow placement and removal of gas vessels in and from the housing, an observation port for viewing the associated equipment, and an access port to permit manual operation of said associated equipment, said observation port having a transparent cover preventing the escape of air and any gas from the housing therethrough, and said access port having a displaceable panel sealingly engaging the access port, said access port being dimensioned and positioned in the wall means to prevent egress of entrained gases through the port when said displaceable panel is displaced and the ventilation means is operating.

2. A gas cabinet as recited in claim 1 wherein said floor member has substantially 42 percent open area.

3. A gas cabinet as recited in claim 2 wherein said wall means comprises a backwall, two sidewalls connected thereto, and means for mounting said access door between said sidewalls opposite said backwall.

4. A gas cabinet as recited in claim 1 wherein said access port is in juxtaposition with said observation port.

5. A gas cabinet as recited in claim 4 wherein said access port is in said access door and said displaceable panel comprises a hinge disposed along one side of said displaceable panel and fastened to said access door such that said displaceable panel may be opened without removal from said access door.

6. A cabinet for enclosing a gas cylinder comprising:

a backwall;

a pair of sidewalls attached to said backwall such that an elongated upright housing is formed having a first open-side opposite said backwall and second and third open-sides at the ends of the housing;

a door hingedly mounted to one of said sidewalls for selectively closing off the first open-side of the housing;

a roof formed for closing off the second open-side, said roof opening into an exhaust conduit formed thereon;

a floor member with openings formed for closing off the third open-side and extending across the full depth and width of the housing, said floor member being constructed to permit free uniform airflow through the full depth and width of said housing end such that an airflow is facilitated for uniformly sweeping the interior of said cabinet;

cabinet support means for elevating the housing such that an air passage is provided between the ambient air and said floor member, whereby any leaking gas from the gas cylinder is effectively swept from the cabinet by ambient air uniformity passing through the floor member openings to the exhaust conduit;

cylinder support means in the housing for mounting and supporting the gas cylinder in the cabinet;

gas control means mounted in the housing for regulating the flow of gas from the gas cylinder in the cabinet; and access port means associated with the door for permitting operator access to the gas control means in the cabinet without opening the door.

7. A cabinet as recited in claim 6 wherein said door comprises:

latch means for maintaining said door in a closed position; and viewing means disposed at the end of said door near said roof for allowing observation of the interior of the cabinet.

8. A cabinet as recited in claim 6 wherein said access port means comprises a hinged panel for closing off said access port means when access is not required.

9. A gas cabinet as recited in claim 6 wherein said exhaust conduit causes ambient air to flow through said floor member, said housing and said roof opening and said floor member has a sufficient number of openings to provide an airflow velocity throughout the cross-sectional area of the cabinet in the range of 66 to 89 feet per minute.

10. A gas cylinder cabinet as recited in claim 6 wherein said floor member has substantially 42 percent open area.

* * * * *